US008221166B2

(12) United States Patent
Heffernan

(10) Patent No.: US 8,221,166 B2
(45) Date of Patent: Jul. 17, 2012

(54) PHANTOM POWER SAVER POWER TAP

(75) Inventor: Gerard Martin Heffernan, St. John's (CA)

(73) Assignee: OnPlug Innovations Inc, St. Johns, NL, AIC (CA)

( * ) Notice: Subject to any disclaimer, the term of this patent is extended or adjusted under 35 U.S.C. 154(b) by 240 days.

(21) Appl. No.: 12/787,592

(22) Filed: May 26, 2010

(65) Prior Publication Data

US 2010/0300861 A1 Dec. 2, 2010

Related U.S. Application Data

(60) Provisional application No. 61/181,407, filed on May 27, 2009.

(51) Int. Cl.
*H01R 13/70* (2006.01)

(52) U.S. Cl. ..... 439/651; 200/51.21; 200/562

(58) Field of Classification Search ..... 200/51.21, 200/562, 51 R; 439/652, 651, 76.1
See application file for complete search history.

(56) References Cited

U.S. PATENT DOCUMENTS 4,875,152 A 10/1989 Foster
D367,262 S 2/1996 Lux
6,416,362 B1 * 7/2002 Conrad et al. ..... 439/651
6,638,074 B1 10/2003 Fisher
6,825,427 B2 * 11/2004 Jenks ..... 200/51.12
7,215,519 B2 * 5/2007 Blumenauer et al. ..... 361/42
7,249,976 B1 * 7/2007 Watson ..... 439/651
7,371,122 B2 * 5/2008 Ivanova et al. ..... 439/652
D588,065 S 3/2009 Wadsworth
7,520,783 B2 * 4/2009 Chou et al. ..... 439/652
D610,092 S 2/2010 Jimenez
2004/0142601 A1 * 7/2004 Luu ..... 439/652
2009/0253307 A1 * 10/2009 Augur ..... 439/652
2010/0038218 A1 2/2010 Fisher
2010/0051427 A1 3/2010 Eikum
2010/0061130 A1 3/2010 Zhang

* cited by examiner

*Primary Examiner* — Gary F. Paumen

(57) ABSTRACT

An apparatus, system and method are disclosed for eliminating phantom power wastage utilizing a power tap. An insulation casing creates a receiving space for a printed circuit board which mounts male blades, female receptacles, phantom power indication and a mechanical electrical switching capability is disclosed. The conductive male blades and female receptacles create a cross pattern for a two pronged power tap that allows miniaturization of the power tap so as to allow full access to adjacent electrical outlets. Switching states include normally open which permits zero power flow and normally closed which permits power indication and allows power to flow from conductive male blades to conductive female receiving receptacles.

13 Claims, 5 Drawing Sheets

PHANTOM POWER SAVER POWER TAP

CROSS REFERENCE TO RELATED APPLICATIONS

This application claims the benefit of PPA Appl No. 61/181,407 filed on May 27, 2009.

FIELD OF INVENTION

The present invention generally relates to a power tap and more particularly to a switchable power tap capable of intervention in the consumption of standby power or phantom power through electrical and mechanical manual intervention.

BACKGROUND OF THE INVENTION

A conventional power tap (sometimes called current tap) includes a plastic electrical insulating case with metal plugs as inserts connected in a manner to fan out electricity from one electrical input to more than one electrical outputs. Conventionally this power is passed through the power tap unobstructed. Typically a power tap would have protruding metal blades. Equally the power tap would have cavities with metal receptacles that accept the insertion of metal blades from electrical plugs and power adapters. Power taps often use metal inserts to route electricity from the protruding blades to the metal receptacles.

Conventional power taps come in forms that provide an electrical fan out scheme that has a single set of male blades and three or six sets of metal female receptacles. These types of power taps have the disadvantage of large size whereby the power tap may plug into an electrical wall outlet and cover over the adjacent outlet. Another disadvantage is that some of the metal receptacles are covered or smothered by electrical plugs inserted or power adapters inserted. This specific disadvantage reduces the utility of a three to one or six to one power tap. A further disadvantage is the lack of control of electrical conductivity between protruding male blades and female receptacles.

Conventional electrical power tap assemblies use an offset approach to assemble male blades and female receptacles whereby the male blades and female receptacles are not in the ideal vertical plane with one another but are often in the same horizontal line up. This causes the need for a larger than necessary power tap which can overlap adjacent outlets. Additionally, a perfectly aligned vertical and horizontal male blades and female blades would cause the height of the power tap to increase in an inefficient manner. As a result the assembly of the power tap becomes larger or the assembly would become less reliable with a higher risk of inadvertent contact between male and female blades causing increased risk of electrical shock.

There is growing concern about global warming caused by the increased levels of green house gases in the atmosphere. This problem is exacerbated by the burning of fossil fuels to generate electricity. More electricity demand drives more burning and increased global warming. Solutions are needed to reduce electricity demand. Macro level fixes and small micro level fixes are equally desirable. The benefit of micros level fixes is that individual consumers can have an impact. It is thought that where power consumption provides some utility or benefit to the user, some harmful environmental side effects are tolerated so long as the benefit is measureable.

Where there is no measureable benefit or wasted power or lost electrical power no environmental side effects can be tolerated.

It is commonly known that modern electronic and electrical devices and appliances consume electricity to perform their intended function. What is not commonly known is that when these electronic and electrical devices and appliances are not performing their intended function, they continue to consume electricity as they have a standby mode that consumes what is less commonly known as phantom power or standby power.

Standby or phantom power consumption is said to comprise up to 10% of a households electricity bill each month. This phantom power provides no useful benefit to the consumer. One common culprit of phantom power are AC-DC adapters and battery chargers used with all sorts of electronics like television sets, cell phones, cordless phones computers and printers. These devices are often left unplugged to consume phantom power without providing a measureable benefit to their owners.

Power adapters and chargers use only a small amount of electricity when in standby mode but it is commonly known that there are hundreds of millions of these in use around the world and collectively they contribute to a sizeable waste of electricity. Many disclosed power adapters and chargers have been designed to reduce power consumption but not eliminate all standby power. Some have even been disclosed that have automatic shut off or automatic detect features that strive to reduce power drain. Other electrical power strips have electrical outlets with one switch per outlet. Even more disclosed products detect power drain on computer peripherals when the computer has been turned off. The disadvantage of standby power detection and automatic shut off is that they have increased points of failure, increased cost, and a larger footprint where these attributes are not desirable.

The Phantom power saver power tap purports to help people consume less phantom power and thus provides a means to reduce energy consumption in homes and offices. To achieve this, the Phantom Power Saver Power Tap utilizes numerous engineering principles and designs that are both novel and unique. These are described herein:

Indicators are provided that highlight the state of power consumption in a manner that indicates consuming power or not consuming power. Indicators of various types are used that include but are not limited to visual, audible, scent, touch, with wireless and wireline based signalling. Visuals may be manifested in the form of lights LEDs etc. Audibles may be manifested in the form of speakers, vibrating devices etc. Smells may be manifested in the form of scent generators etc. Feels may be manifested in the form of vibrating or temperature changing devices etc. Wireless indicators could be radio frequency based in a controlled spectrum or free spectrum. Wired indicators may use dedicated communications wiring or may use may use power line wiring. FIG. 8 depicts these indicator functions schematically—only the LED variation is shown in the figures.

Intervention function. The most common forms of intervention of power consumption are in the mode of unplugging or using an on off switch. The problems are that many people find unplugging inconvenient and many switches do not turn off the appliance off in its entirety. Thus an intervention device or switch or unplugging method, external to the appliance is needed. This intervention can be manifested in the form of a double pole double throw switch, a single pole single throw switch, or a mechanical formed switch of metal or plastic or an electrical pulse or wireless pulse or signal.

A phantom power saving power tap can begin to eliminate this phantom power loss though manual intervention. Conventional Power taps, power strips and power adapters with automatic detection and automatic shut off or automatic disconnect or power taps operated by remote controls introduce more points of failure and often consume electrical power in the power detection stage and in the power disconnect stage.

Consequently, there is still a need for certainty in the elimination of phantom power, where this certainty can only come from human intervention of manually activating a normally closed switch to the open position where electricity is disconnected from phantom electrical loads with the greatest certainty.

In order to overcome the disadvantages of usefulness, size and lack of control a phantom power saving power tap is disclosed which includes a single set of male blades and either a single set of receptacles or two sets of receptacles. The assembly is such that two can be used on a typical household electrical outlet. The ninety degree rotation of male blades and female receptacles is not intuitive but allows for enhanced miniaturization. The placement of male blades between female receptacles is also not intuitive, nor obvious. The ninety degree rotation is also not intuitive or obvious because often plugs have a third prong for ground. This invention is focused on miniaturizing the power tap for two pronged devices.

SUMMARY OF THE INVENTION

I have invented an external intermediary phantom power saver power tap apparatus that provides the ability to switch off phantom power loads through manual human intervention. The apparatus attaches to an electrical power source on one side and to an electrical load or device on the opposite side thus situating itself as an intermediary switch apparatus between the power source and phantom electrical load. The apparatus comprises firstly a power accessing plug on the rear side which has protruding properly sized and polarized male blades or prongs. Secondly, on the front side the apparatus is comprised of cavities formed to accept the insertion of a properly sized and polarized electrical plug or set of polarized blades. Thirdly the apparatus is comprised of a printed circuit board with circuitry used to provide indication that power is being consumed as well as a single pole single throw switch and of course a portion of the male and female blades or prongs. When the switch is in the normally closed position electrical power flows from the hot male prong through the switch and is passed directly to the female prongs and out to the connected electronic equipment or power adapter. Also with the switch in the normally closed position, a small amount of electricity is diverted through an electrical circuit to power the indicator function making it active. The indicator function in this case may be visual, audible, scented, touch, wireless and wireline based signalling. In the case of the visual indicator function the preferred embodiment is a light emitting diode. With the indicator active it becomes obvious that power is being consumed and the correct action can be taken to continue to allow power to be consumed or to manually turn the switch to the normally open position to disallow any power from being consumed. With the switch in the normally open position, no electrical power is provided to the female blades or connected device and no electrical power is provided to the electrical circuit that powers the indicator function.

Blade orientation; critical to the design of a plug and receptacle in one device, power tap, current tap or power bar is its compactness. To that end the interspersed 15 R and 15P male blade and female receptacles in an 'above' or 'on' manner or in a cross pattern configuration is critical to this application. Blade layout such that female blade receptacles are directly above male receptacles but are rotated by either plus ninety degrees or minus ninety degrees are critical to the design. This orientation provides the ability for a current tap or power bar to be used without covering adjacent wall outlets. This orientation provides the ability for multiple current taps to be installed on the same electrical outlet or on the same power bar. This orientation also enables a small size that itself enables multiple devices or current taps or power bars per outlet. The physical size is critical to the usability of the device. As can be seen from FIG. 5 it is important that two Phantom Power Saver Switches be installed at a single dual AC wall outlet.

The apparatus is also intended to provide mobility and compatibility in that it can remain attached to the electronic device or adapter when it is required to move from one location to another.

The apparatus can also be used as per above but without the indicator function.

I have also invented a system comprising a phantom power saving power tap apparatus as described above with the addition of an electrical device and a source of electricity.

In addition, I have invented a method whereby a single electrical device can eliminate the consumption of phantom power. The method comprises four steps. The first step is the location and placement of the present invention apparatus between an electrical power source and an electrical device or power adapter. The second step is the application of electricity to the apparatus. Another step is the manual application of electrical power to the female blades and circuitry to enable both the indicator function and the provision of electrical power to the female blades. Still another step is the removal of electricity from the blades and the electrical circuitry through manual application of a physical electrical switch.

This invention offers a substantial reduction in electricity production and consumption. This creates a reduction in green house gas production and has an added benefit of reducing electricity costs for consumers. According to Canadian government research, over ten percent of a home's electricity costs are comprised of phantom power devices. This invention targets a well known contributor to this phantom power loss, namely power adapters and battery chargers commonly used in mobile phones, laptop computers, cordless phones, baby monitors amongst other electronic appliances.

Of course this invention would not be needed if every person unplugged all of their electronic devices when not providing useful functions. But human nature being what it is people often do not want to unplug devices, forget to unplug devices, find it physically difficult to unplug devices due to the amount of strength needed, or have electrical outlets in inconvenient locations that make unplugging a difficult chore. My invention with its indicator function intends to remind people that their power adapters and chargers have been left plugged in, so that they may manually turn them off until they are needed again.

A novel implementation is the use of a printed circuit technology to integrate the various functions of this Phantom Power Saver Power Tap. Typically power taps, current taps and power bars have adopted pressed or stamped metal parts or wiring harnesses to form conductive paths for power distribution. The benefit of the printed circuit board is that it provides the ability of a power bar and the benefit of a power bar to be used without wires or cabling.

A two piece plastic insulation housing is conceived where the printed circuit board can be inserted into or may rest upon one part where the second part is attached. The housing shell made of polycarbonate or other plastic material shall contain cavities that will separate blades and connectors from each other. Holes shall be made in the plastic parts for which blades may pass through.

An objective of the present invention is to provide a power tap that indicates phantom power is being consumed.

Another objective of the present invention is to provide a power tap with a manual means for users to switch off their power consumption.

Yet another objective of the present invention is to provide a power tap that does not block adjacent wall electrical outlets.

Yet further objective of the present invention is to provide a low profile power tap that improves aesthetics and usability for use in households.

Yet another objective of the present invention is to provide a polarized version of a two pronged electrical tap that is optimized for a single or dual device powering and switching.

BRIEF DESCRIPTION OF THE DRAWINGS

The present invention will be apparent to those skilled in the art by reviewing the following diagrams and correlating these figures to the descriptions of the embodiments contained herein.

DETAILED DESCRIPTION OF THE INVENTION

Apparatus Aspect

Figure 1:
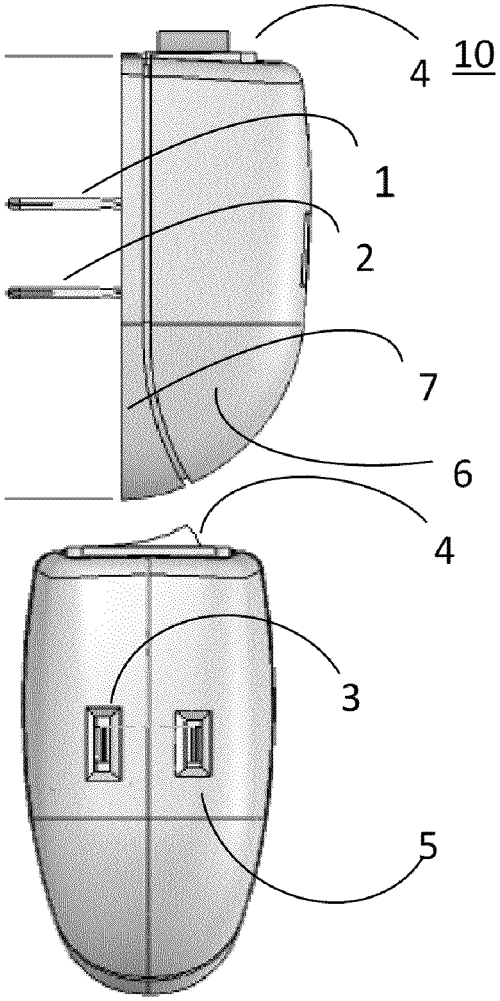
FIG. 1. is an assembled perspective view of an embodiment of the phantom power saver power tap showing the left hand side and the front face.
Figure 2:
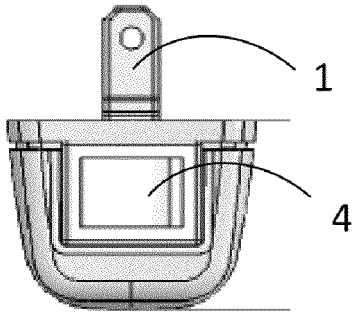
FIG. 2 is a side on perspective view of an embodiment of the invention showing the top side which contains the switch.
Figure 3:
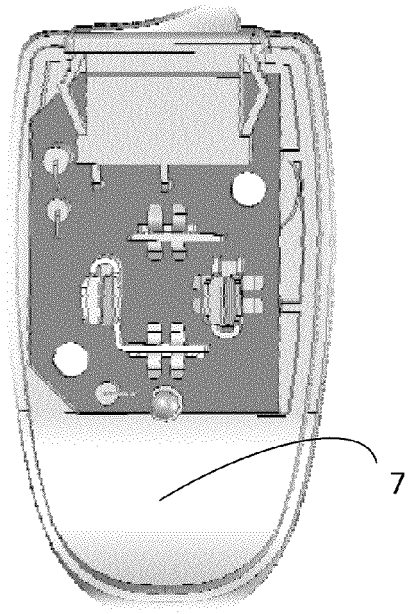
FIG. 3 Is a partial exploded view showing top insulation casing removed to leave assembled printed circuit board received in bottom insulation casing
Figure 4:
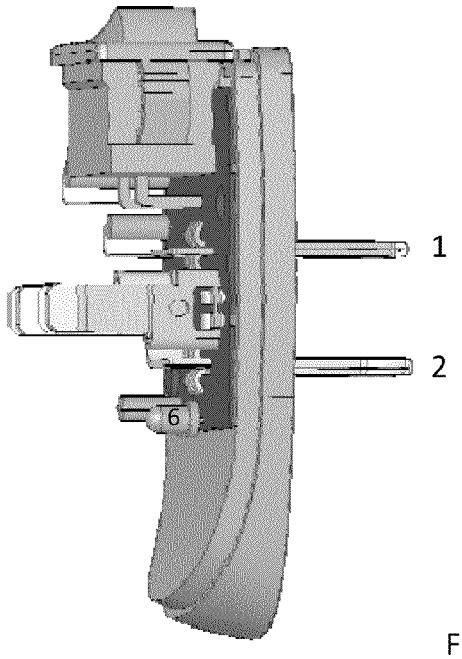
FIG. 4 is a partial exploded view as in FIG. 3, but showing the right hand side with blades visible on the underside
Figure 5:
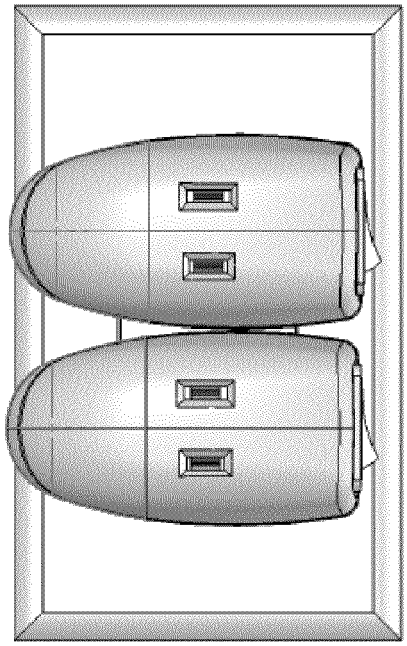
FIG. 5 shows an embodiment with actual size depicting two devices situated side by side on an electrical outlet

Referring to FIG. 1 showing a first preferred embodiment of the phantom power saver switch power tap in accordance with the present invention, the power tap 10 includes a first insulation casing 6 and a second insulation casing 7 coupled to the first insulation casing 6 to form a closed space to receive a printed circuit board 8, a pair of conductive male blades 1,2, a pair of conductive female receptacles as accessed through holes 3,5 and a switch 4 therein.

The second insulation casing 7 defines a receiving space to seat the printed circuit board where the male blades 1, 2 pass though rectangular holes 11,12 to form a pair of male electrical plug blades external to insulation casing 7, leaving the printed circuit board seated in receiving space of insulation casing 7.

The printed circuit board defines a pair of male blades 1,2 visible externally to insulation casing 7 and a pair of receiving female receptacle holes 3,5. The male blades 1,2 extend outside the insulation casing 7, while the female receptacle holes 3,5 are visible from outside the insulation casing 6 through two not identical rectangular holes. Through the female receptacle holes 3,5, the female receiving receptacles define a receiving space 14,15 through conductive female receptacles.

In another embodiment each of the conducting members is substantially formed to perform its function 13, 14, 15, 16. The male blade 13 is inserted through the top of the printed circuit board to appear predominantly below the printed circuit board to create a male blade, while a portion of the male conducting member snaps into place on the top side of the printed circuit board 13.

The female receptacle 14 is inserted through the top of the printed circuit board to rest in a position predominantly on top of the printed circuit board while a portion remains below the printed circuit board and snaps into place on the bottom side of the printed circuit board.

The female blade receptacles provide tension and retention so that any male blade inserted through holes 3,5 can only be removed with direct intentional force.

In another embodiment, the conducting member 15,16 is substantially formed in an L shape to allow its function as both a male blade 2,16 inserted through the top of the printed circuit board to appear predominantly below the printed circuit board to create a male blade and a female receptacle 15 which rests in a position predominantly on top of the printed circuit board.

Figure 6:
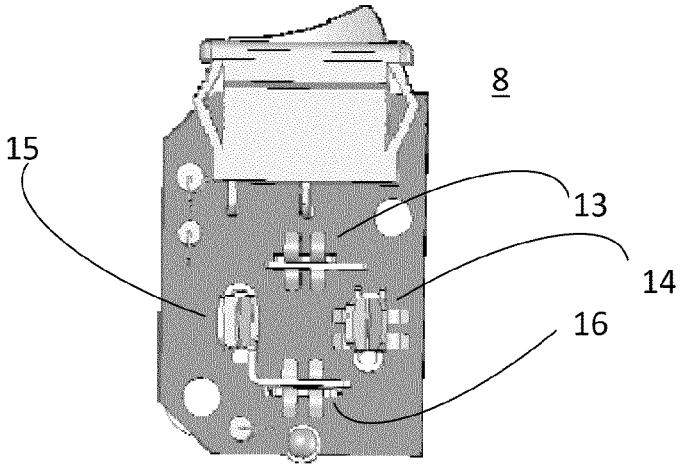
FIG. 6 shows top view of printed circuit board assembly
Figure 7:
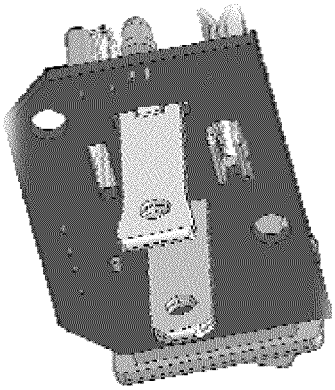
FIG. 7 shows the bottom view of the underside of the assembled printed circuit board

The male blade 1 in FIG. 1 presented externally is the same part as the male blade 13 presented internally in FIG. 6, while the male blade 2 in FIG. 1 presented externally is the same part as the male blade 16 in FIG. 6. The female receptacle, accessible externally though hole 3 is the same part internally as female blade receptacle 15 in FIG. 6 while the female blade receptacle accessible externally in FIG. 1 is the same part as the female receptacle 14 in FIG. 6.

The L shaped blade 15,16 the male blade 13 and the female blade 14 form the on plug arrangement where through a ninety degree rotation of two blades of the female receptacles 14,15, the two female receptacles can be contained in the same square area of the plug area as the two male blades therein. The male blades 13, 16 are considered to be aligned in the vertical plane at zero degrees, where the female blade receptacles are considered to be aligned at ninety degrees clockwise rotation or ninety degrees counterclockwise rotation, aligned with a horizontal plane, as in FIG. 6.

Once the printed circuit board 8 is seated in the insulation casing 7, insulation casing 6 is coupled to insulation casing 7.

The insulation casing 6 contains an internal rib structure 17, 18 that encloses the female receptacles 14, 15 for electrical isolation and physical isolation and physical protection. The wall ribs serve to restrict movement of any male blade that becomes inserted through holes 3,5 making contact with female receptacles 14,15. The receptacles themselves restrict motion in the horizontal plane so the wall ribs invention serves to restrict motion in the vertical plane.

Figure 8:
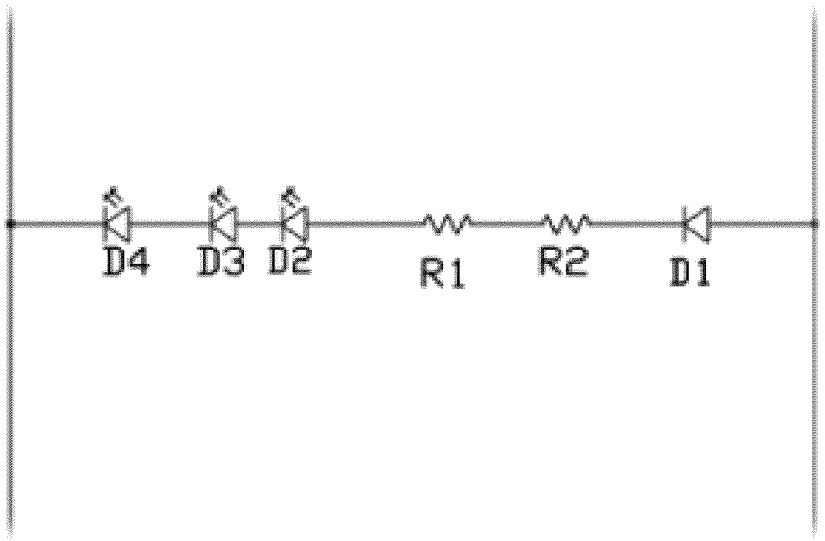
FIG. 8 is an electrical circuit schematic of an embodiment of the invention of a phantom power saver power tap.
Figure 9:
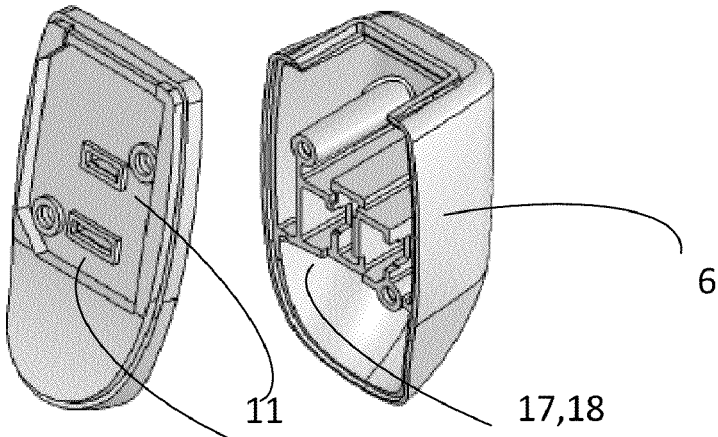
FIG. 9 is an exploded view of the top insulation casing and the bottom insulation casing all shown from the insides to display the ribbing and support structural design
Figure 10:
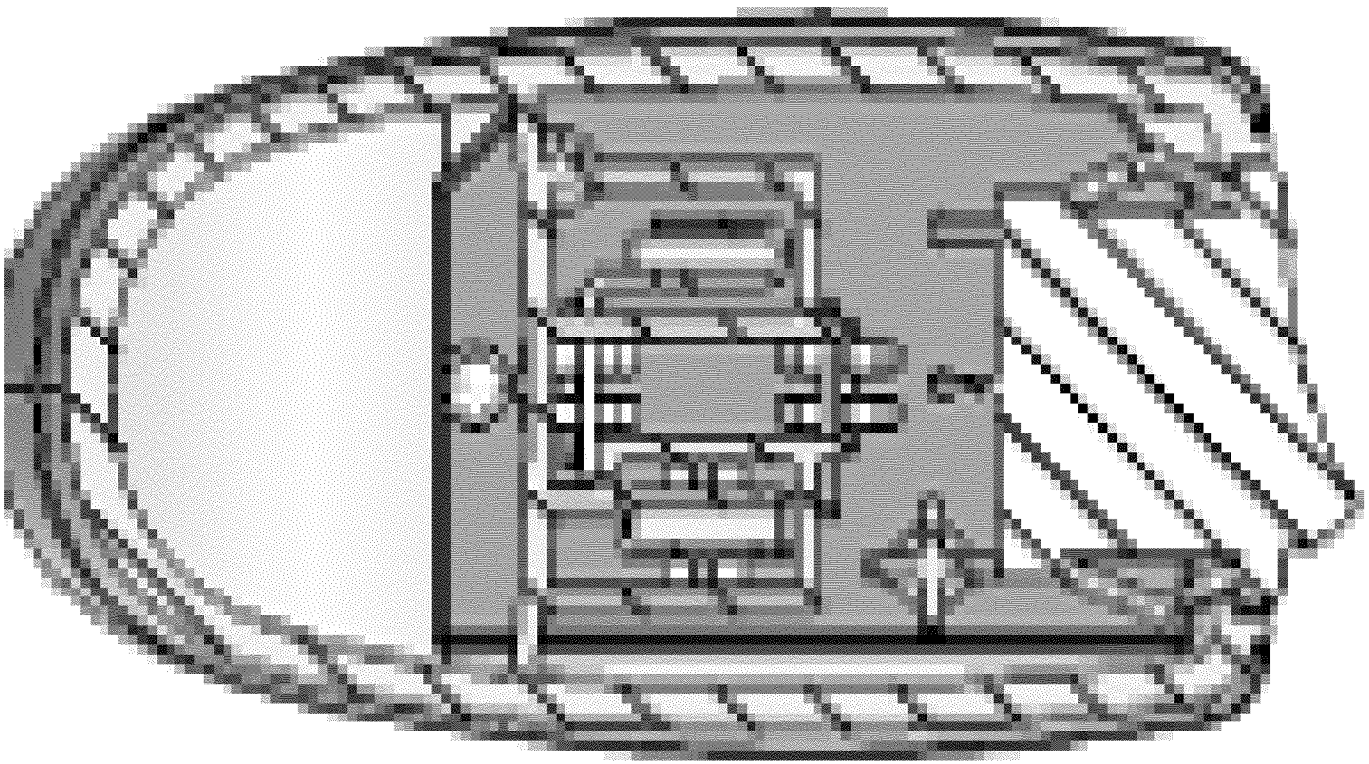
FIG. 10 is a cross hatched view of the top insulation casing that displays casing ribbing against the back drop of the assembled printed circuit board.

Rectification. The Phantom Power Saver Power Tap will require power to provide indication and intends to get this power from the AC mains power but will rectify this AC power only partially so that indicators can be made active. A rectifier circuit containing a single diode will be used to provide partial rectification of the AC mains power line. See FIG. 8.

Resistive voltage reduction. After rectifying the voltage, a resistive network is used to reduce voltage levels before it reaches the indicators. See FIG. 8.

Insulation casing 7 is comprised of a translucent material to allow the passage of light.

SYSTEM Aspect

Also disclosed is a system that acts as an intermediary switch and power distribution point between a source of electrical power and an electrical or electronic device. It is commonly know that when one turns off their television, it is not truly off. Electronic systems that have a remote control feature have electronic circuitry that remains on eagerly awaiting the signal from a remote control. While in this standby mode appliances like televisions consume phantom power. Some people seek to eliminate all phantom power consumption in their homes and office but manufacturers are reluctant to solve this problem at their system level. This reluctance creates a need for invention of intermediary devices that can truly switch off electronic appliances. The disclosed system eliminates the consumption of phantom power for all electronic devices plugged into it.

The system aspect of the disclosed invention comprises a source of electrical power, an electronic device presented as an electrical load and an intermediary phantom power saver power tap apparatus. The power tap apparatus has been described above. The system permits the appliance to remain in a plugged-into-the-wall state, while providing a means to eliminate the phantom power consumed by the system.

METHOD Aspect

In addition I have invented a method whereby a single electrical device can eliminate the consumption of phantom power without the need for elaborate electronic circuitry to provide power detection and automatically act on a given power state. The method allows for the continued use of adjacent electrical outlets without covering them unnecessarily. The method also allows for the critical manual intervention that proves to be the most energy efficient means to reduce phantom power consumption with the greatest reliability.

The method comprises four steps. The first step is the location and placement of the present invention apparatus between an electrical power source and an electrical device or power adapter. The second step is the application of electricity to the apparatus. Another step is the manual application of electrical power to the female blades and circuitry to enable both the indicator function and the provision of electrical power to the female blades. Still another step is the removal of electricity from the blades and the electrical circuitry through manual application of a physical electrical switch.

Modifications permutations and changes made to the claims and description of the embodiments to fit the aforementioned application will be apparent to those skilled in the art. All omissions, substitutions and changes are considered as forming embodiments not aforementioned and thus do not constitute departures from the apparatus, system or method as disclosed and do not deviate from the spirit of the invention.

The invention claimed is:

1. A phantom-power saver power tap apparatus comprising: An insulation casing; a printed circuit board received in the insulation casing; at least one female conductive member having at least one fixed portion located on the printed circuit board and defining a retaining portion and receiving space; at least one male conductive member having at least one fixed portion located on the printed circuit board and defining a blade end protruding out of the insulation casing; and at least one mechanical switch received in the insulation casing (1) having an open position when connectivity between conducting members is not required enabling zero electricity consumption and (2) having a closed position when it is desirable to have electricity pass between male and female conducting members.

2. The power tap apparatus of claim 1 wherein an electrical circuit is used to provide indication of active phantom power consumption.

3. The power tap apparatus of claim 1 wherein there is no electrical circuit to provide indication of active electrical power consumption.

4. The power tap apparatus of claim 1 wherein at least one conductive member is an L shaped combination of female conductive receiving member and male blade conductive member.

5. The power tap apparatus of claim 1 wherein there is a ninety degree rotation between a pair of male conductive blades and a pair of female conductive receiving receptacles and space thus forming a cross configuration with the two male blades in one plane and the two receiving female members in another plane that is rotated either plus ninety degrees or minus ninety degrees.

6. An electrically powered system comprising an electrically powered device and a phantom-power saver power tap apparatus comprising: An insulation casing; a printed circuit board received in the insulation casing; at least one female conductive member having at least one fixed portion located on the printed circuit board and defining a retaining portion and receiving space; at least one male conductive member having at least one fixed portion located on the printed circuit board and defining a blade end protruding out of the insulation casing; and at least one mechanical switch received in the insulation casing (1) having an open position when connectivity between conducting members is not required to enable zero electricity consumption and (2) having a closed position when it is desirable to have electricity pass between male and female conducting members.

7. The system of claim 6 wherein an electrical circuit is used to provide indication of active phantom power consumption.

8. The system of claim 6 wherein there is no electrical circuit to provide indication of active electrical power consumption.

9. The system of claim 6 wherein at least one conductive member is an L shaped combination of female conductive member and male blade conductive member.

10. The system of claim 6 wherein there is a ninety degree rotation between a pair of male conductive blades and a pair of female conductive receiving receptacles and space thus forming a cross configuration with the two male blades in one plane and the two receiving female members in another plane that is rotated either plus ninety degrees or minus ninety degrees.

11. A method of using a phantom-power saver power tap apparatus to convey power to an electrical device with the power tap only consuming power while providing an indication of phantom power consumption when an external device is attached to the power tap and the power tap is acting as an intermediary switching system comprising; an insulation casing; a printed circuit board received in the insulation casing; at least one female conductive member having at least one fixed portion located on the printed circuit board and defining a retaining portion and receiving space; and at least one male conductive member having at least one fixed portion located on the printed circuit board and defining a blade end protruding out of the insulation casing; at least one mechanical switch received in the insulation casing (1) having an open position when connectivity between conducting members is not required to enable zero electricity consumption and (2) having a closed position when it is desirable to have electricity pass between male and female conducting members.

12. The method of claim 11, further comprising leaving the power tap connected to the source of electricity with automatic indication of phantom power consumption and manual intervention to turn the switch off to eliminate more power being drawn by the device attached to the power tap.

13. The method of claim 11, further comprising turning the switch back on to re-establish electrical power connectivity to the device connected to the power tap.

* * * * *